US005799838A

United States Patent [19]

Miller

[11] Patent Number: 5,799,838

[45] Date of Patent: Sep. 1, 1998

[54] DUAL OPENING CONTAINER CAP

[75] Inventor: Albert R. Miller, Hinsdale, Ill.

[73] Assignee: Phoenix Closures, Inc., Naperville, Ill.

[21] Appl. No.: 790,107

[22] Filed: Jan. 29, 1997

[51] Int. Cl.[6] ..... B67D 3/00

[52] U.S. Cl. ..... 222/480; 222/482; 222/556; 220/254; 220/339; 215/237

[58] Field of Search ..... 222/480, 482, 222/556, 565; 215/234, 237, 238; 220/254, 337, 339

[56] References Cited

U.S. PATENT DOCUMENTS

| | | | |
|---|---|---|---|
| 4,693,399 | 9/1987 | Hickman et al. | 222/480 |
| 4,714,181 | 12/1987 | Kozlowski et al. | 222/480 |
| 4,898,292 | 2/1990 | VerWeyst et al. | 215/237 |
| 4,925,067 | 5/1990 | Zemlo et al. | 222/480 |
| 5,139,181 | 8/1992 | VerWeyst | 222/480 |
| 5,219,100 | 6/1993 | Beck et al. | 222/480 |

*Primary Examiner*—J. Casimer Jacyna
*Attorney, Agent, or Firm*—Welsh & Katz, Ltd.

[57] ABSTRACT

A dual opening dispensing closure for use with an associated container includes a closure cap having a circular top wall portion and a depending annular skirt portion depending from the top wall portion. The top wall portion defines a pair of open dispensing regions. The cap includes a pair of flap-like cover portions. Each cover portion is adapted to cover a respective one of the dispensing regions. Each cover portion is connected to the top wall portion by a respective hinge region. Each hinge region defines a hinge line. The hinge lines are in spaced relation to one another and are separated from one another by a secant line extending across the cap. The hinge lines can be parallel to one another and formed generally perpendicular to the secant line. The cover portions are pivotable between an open position and a closed position independent of one another, and can be configured to pivot between the open and closed positions without interfering with pivoting of the other cover portion.

8 Claims, 2 Drawing Sheets

DUAL OPENING CONTAINER CAP

FIELD OF THE INVENTION

This invention relates to a container cap. More particularly, the invention relates to a dispensing-type container cap having dual, inwardly opening, non-interfering flap-type doors.

BACKGROUND OF THE INVENTION

Containers having a dispensing-type cap are known in the art. One type of dispensing container includes a threaded closure cap (an over-cap) and a perforated fitment fit onto the container, below the cap, for dispensing the contents of the container. Such an arrangement may be used, for example, for storing and dispensing herbs and spices.

One variation of this type of container includes a fitment having a relatively large opening for dispensing or spooning large (e.g., poured or measured) amounts of the contained material, in combination with a plurality of relatively small perforations or openings in the fitment for non-measured dispensing (e.g., shaking or sprinkling) of the material from the container.

Another known type of container closure includes a cap having flaps or covers hingedly mounted to the cap. The flaps are symmetrically positioned on the cap and share a hinge portion that extends across the cap, generally through the center thereof. Alternately, the hinge portions of the known dual-flap type caps may be positioned separated from one another in back-to-back relation relative to each other, with the area between the flaps defining a hinge region. When closed, the flaps retard spoilage and can extend the life of the material stored in the container.

The flap-type caps eliminate the need for an additional cap element (e.g., an over-cap) covering the dispensing portion. Whereas such a cap eliminates one or more member from the closure assembly, generally, the shared or back-to-back hinge portions can produce a concentrated area of weakness in the cap that is subject to high fatigue stresses and possible premature failure.

Accordingly, there continues to be a need for a flap-type closure cap for a container which eliminates the need for an over-cap while permitting both measured and shaken dispensing of material from the container. Preferably, such a cap includes separated and strengthened hinge portions to reduce the opportunity for fatigue failure of the cap material.

SUMMARY OF THE INVENTION

A dual opening dispensing closure for use with an associated container has first and second independently usable dispensing openings formed therein. The closure includes a closure cap having a circular top wall portion and a depending annular skirt portion depending from the top wall portion. The closure can be used on a container for storing and dispensing, for example, herbs and spices.

The cap includes first and second independent flap-like cover portions for covering the respective dispensing regions. The cover portions are connected to the top wall portion by separate and distinct hinge regions. The hinge regions define respective first and second hinge lines. The hinge lines are in spaced relation to one another, lying on opposing sides of a secant line traversing the top wall of the cap. The hinge lines can be parallel to one another and can be perpendicular to the secant line. The cover portions can each rotate or pivot between an open and a closed position. The cover portions can be configured to pivot independent of one another, without interfering with each other.

In a preferred embodiment, the hinge lines are disposed on the top wall portion such that an extension of either hinge line will intersect the other dispensing region. Preferably, the dispensing regions are separated by a separating portion extending coextensively with the secant line. In a current embodiment, the separating portion includes a rib.

The cap can be formed having a sealing surface extending around at least a portion of at least one of the dispensing openings. The sealing surface can be engageable with its respective cover portion to define a seal at the juncture of the cover and the sealing surface.

In a most preferred embodiment, the covers include gripping extensions that extend from the cover portions toward the periphery of the cap, away from their respective hinge regions. The cap can include recessed regions formed in an outer surface of the skirt portion, at the juncture of the skirt portion and the top wall portion, adjacent to the gripping extensions. The extensions in combination with the recessed regions facilitate opening the covers by providing an area for a user to grasp the cover and urge it upwardly, into an open position.

The closure can be formed with a plurality of relatively small perforations in one of the dispensing regions to permit shaking or sprinkling the contents of the container therefrom.

Other features and advantages of the present invention will be apparent from the following detailed description, the accompanying drawings, and the appended claims.

DETAILED DESCRIPTION OF THE PREFERRED EMBODIMENTS

Figure 1:
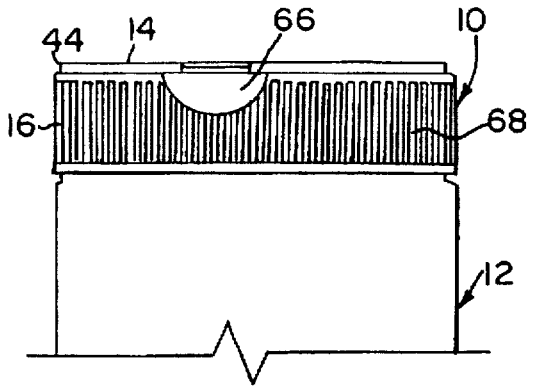
FIG. 1 is a front elevational view of a dual opening container cap embodying the principles of the present invention, illustrated atop a container, the cap being shown so as to illustrate the recessed region.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

Referring now to the figures and particularly to FIG. 1, there is shown a dual-opening container cap 10 embodying the present invention. The cap is illustrated positioned on a container 12. The cap 10 includes a circular top wall portion 14 and a depending annular skirt portion 16 depending from the top wall portion 14.

Figure 2:
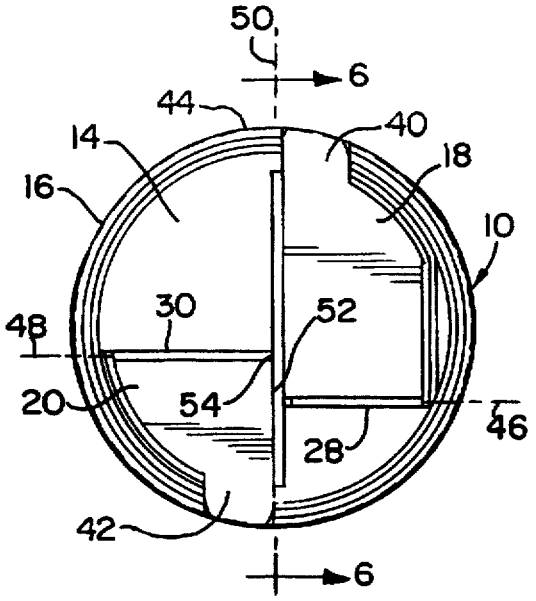
FIG. 2 is a top view of the cap of FIG. 1 shown with the flaps or covers in the closed position.
Figure 3:
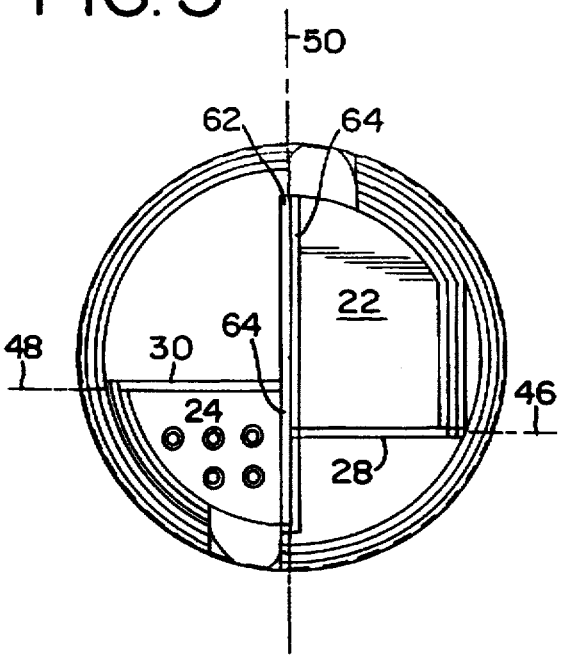
FIG. 3 is a view similar to FIG. 2, shown with the flaps removed for clarity of illustration.
Figure 4:
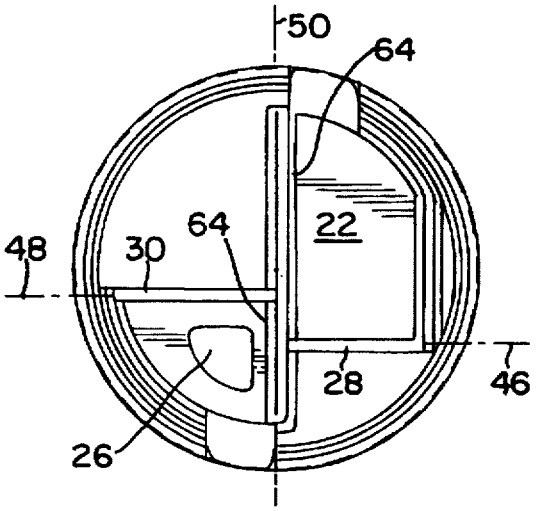
FIG. 4 is an alternate embodiment of the cap of FIG. 2 shown with the flaps removed for clarity of illustration.

Referring to FIGS. 2–4, the cap 10 has first and second covers or flaps 18, 20 that cover first and second dispensing openings, 22, 24, respectively. It is anticipated that the cap 10 will be used for containers 12 storing, for example, foodstuffs such as condiments, herbs and spices, and powdered goods, such as powered coffee creamer. Because the characteristics, e.g., size and shape, of the foodstuffs stored in the container 12 can vary considerably, the dispensing openings 22, 24 can be provided in various forms and sizes.

For example, as shown in FIGS. 3 and 4, an opening 22 of sufficient size to place a spoon within the container 12 can be provided. As illustrated in FIG. 3, a plurality of relatively smaller openings 24 can be provided such that the contents can be shaken or sprinkled from the container 14. Alternately, as illustrated in FIG. 4, an opening 26 can be provided from which the contents can be poured from the container 12. It will be recognized by those skilled in the art that a wide variety of opening types and sizes can be provided. The openings shown in the figures and described herein are illustrative only and are not to be construed to limit the scope of the present invention.

Figure 7:
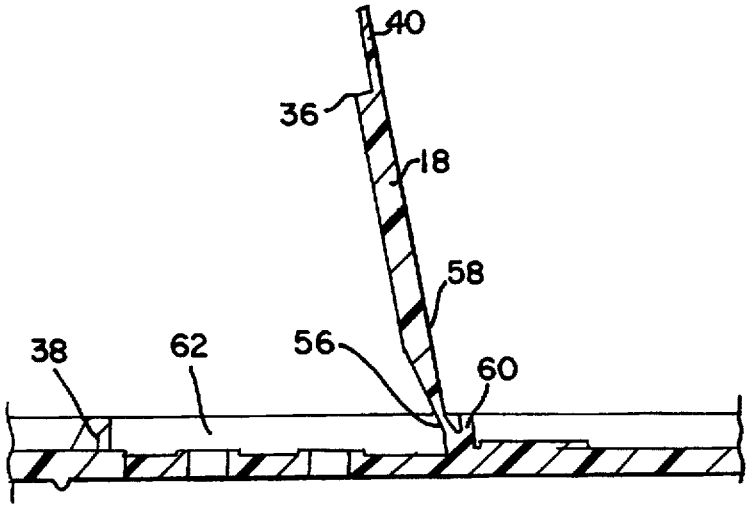
FIG. 7 is an enlarged view of the hinge region of the cap illustrated with one flap in the open position.
Figure 8:
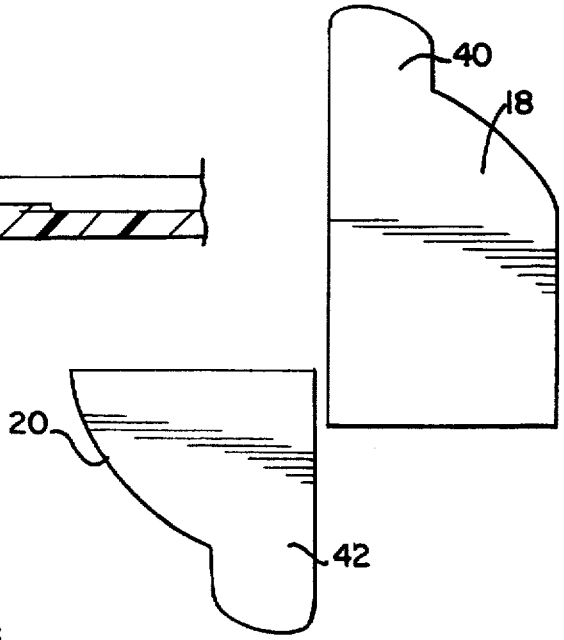
FIG. 8 is an illustration of the flaps or covers of the cap, showing the gripping extensions extending therefrom.

The flaps 18, 20 are connected to the top wall portion 14 at respective hinge regions 28, 30. The hinge regions 28, 30 permit the flaps 18, 20 to be rotated or pivoted upwardly, from the top wall portion 14, and downwardly onto the top wall portion 14, between an open position and a closed position, as indicated by the arrows at 32 and 34 in FIG. 5. Referring to FIG. 7, the flaps can each include a locking region 36 which coacts with a lip 38 extending upwardly from the top wall portion 14 to lock the flap 18 in the closed position. Optionally, the flaps 18, 20 may include grasping extensions 40, 42 that extend therefrom toward the periphery 44 of the cap. The grasping extensions 40, 42 ease opening the flaps 18, 20 by providing an area for a user to grasp or engage the flaps 18, 20 and urge the flaps 18, 20 upward to the open position.

Referring now to FIGS. 2–4, each hinge region defines a hinge line 46, 48. The hinge lines 46, 48 each extend essentially coextensive with the axis of rotation of the flap 18, 20. The hinge lines 46, 48 are spaced from one another and preferably are parallel to one another. Advantageously, the parallel and spaced positioning of the hinge lines 46, 48 relative to one another define hinges 28, 30 that are bidirectionally spaced from each other. That is, when the hinges 28, 30 are viewed relative to a secant traversing the cap, as illustrated at 50, the hinges 28, 30 are positioned on opposite sides of the secant line 50 and the hinge lines 46, 48 intersect the secant line 50 at different points, as illustrated at 52 and 54, respectively. Preferably, the hinge lines 46, 48 are perpendicular to the secant 50.

Figure 6:
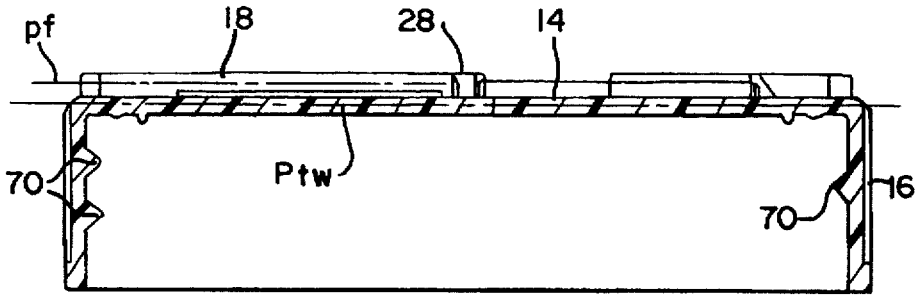
FIG. 6 is a cross-sectional view of the cap taken along line 6—6 of FIG. 2.

Referring to FIG. 7, in a current embodiment, the hinges 28, 30 are formed by a relatively thin, flexible area 56 extending between a base portion 58 of the flap 18 and a standard 60 that extends upwardly from the top wall portion 14. The standard 60 may be formed such that the hinge 28 lies above the top wall 14. Alternately, the hinge 28 may be formed flush with the top wall 14. In a preferred configuration, as seen in FIG. 6, the hinge 28 is formed such that the cover or flap 18 lies in a plane $P_f$ parallel to the plane $P_{tw}$ of the top wall 14 when the flap 18 is closed.

Figure 5:
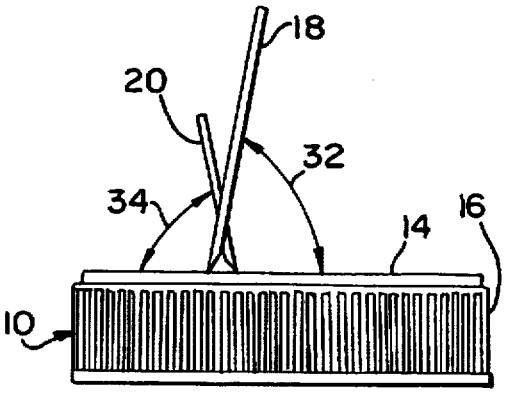
FIG. 5 is an elevational view of the cap illustrated with the flaps in the open position.

The bidirectionally separated hinges 28, 30 separate the hinge lines 46, 48, from one another. It has been observed in known caps, that the hinges tend to produce an area of weakness due to fatigue and other stresses induced as a result of repeatedly opening and closing the flaps. Thus, spacing the hinge lines 46, 48 and the hinges 28, 30, as in the present cap 10, provides a less concentrated area of fatigue resulting in increased structural integrity over known flap-type caps. Moreover, as illustrated in FIGS. 2 and 5, the parallel and spaced hinges 28, 30 permit the flaps 18, 20 to be opened independently of one another, without interfering with one another. This provides an advantage over caps that have back-to-back flaps that overlap with one another, in that such back-to-back flaps can interfere with each other and can thus prevent independent dispensing opening use.

In a current embodiment, the dispensing openings 22, 24 are separated from one another by a separating portion, such as the exemplary rib 62, extending across the cap 10. The rib 62 can be configured to provide additional structural strength to the cap 10, and can also provide a portion of a sealing surface 64 against which the flaps 18, 20 close, to provide a seal for the container 12 contents. The seal between the flaps 18, 20 and the sealing surfaces 64 can help maintain the container contents fresh and prolong the life thereof. The seal between the flaps 18, 20 and the sealing surfaces 64 can also prevent the introduction of foreign matter and contaminants into the container.

Optionally, as illustrated in FIG. 1, the cap 10 can include recessed or indented regions 66 (one shown), formed in the outer surface 68 of the skirt portion 16, at the juncture of the skirt portion 16 and the top wall portion 14, adjacent to the grasping extensions 40, 42. The recessed regions 66, in conjunction with the extensions 40, 42, facilitate easy opening of the flaps 18, 20 by providing areas for applying finger pressure to the extensions 40, 42 to urge the flaps 18, 20 upward.

The closure 10 as illustrated includes internal threads 70 formed in the depending skirt portion 16 for engaging a complementary threaded container 12. It will, however, be recognized by those skilled in the art that the present closure 10 can be formed so as to snap onto a container, or the closure 10 can be made to mate with or engage an associated container in a variety of other configurations. All such configurations of engaging the closure with the container are within the scope of the present invention.

Figure 9:
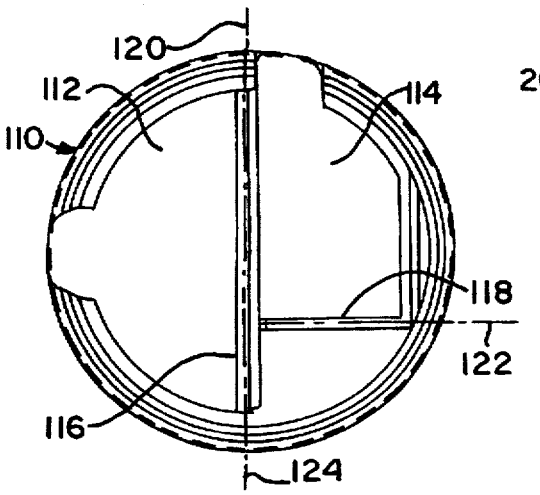
FIG. 9 is a top elevational view of an alternate embodiment of the cap shown with the flaps or covers in the closed position.

An alternate embodiment 110 of the closure is illustrated in FIG. 9. The closure 110 includes first and second cover portions 112, 114 that pivot about respective hinge regions 116 and 118. The hinge regions 116, 118 define hinge lines 120, 122, respectively. In this embodiment, the hinge lines 120, 122 are not parallel to one another, but rather intersect one another when the hinge lines are each extended in a straight line from and beyond their respective cover portion 112, 114 bases.

As can be seen from FIG. 9, the hinge lines 120, 122 are perpendicular to one another, with one of the lines 120, being parallel to the secant line 124. It will, however, be recognized by those skilled in the art that the lines 120, 122 can be at angles other than 90° relative to one another, and that the hinge lines 120, 122 can be formed at any angle relative to, including parallel to, the secant line 124.

From the foregoing it will be observed that numerous modifications and variations can be effectuated without departing from the true spirit and scope of the novel concepts of the present invention. It is to be understood that no limitation with respect to the specific embodiment illustrated is intended or should be inferred. The disclosure is intended to cover by the appended claims all such modifications as fall within the scope of the claims.

What is claimed is:

1. A dual opening dispensing closure for use with an associated container comprising:

a closure cap having a circular top wall portion and a depending annular skirt portion depending from said top wall portion, said top wall portion defining first and second open dispensing regions therein;

a first cover portion for covering said first dispensing region, said first cover portion being connected to said top wall portion by a first hinge region; and a second cover portion for covering said second dispensing region, said second cover portion being connected to said top wall portion by a second hinge region, a separating portion extending between and separating said first and second dispensing regions, wherein said first and second hinge regions define respective first and second hinge lines, each said hinge line being transverse to said separating portion, said hinge lines being in non-intersecting relation to one another and intersecting said separating portion in spaced relation to one another.

2. The dual opening dispensing closure in accordance with claim 1 wherein said separating portion includes a rib element.

3. The dual opening dispensing closure in accordance with claim 1 wherein at least one of said hinge lines is disposed on said top wall portion so as to intersect said separating portion opposingly of the other of said dispensing regions.

4. The dual opening dispensing closure in accordance with claim 1 wherein at least one of said dispensing openings defines a plurality of relatively small perforations.

5. The dual opening dispensing closure in accordance with claim 1, wherein at least one of said first and second cover portions includes a gripping extension extending therefrom, away from its respective hinge region.

6. The dual opening dispensing closure in accordance with claim 5, wherein said closure includes a recessed area formed in an outer surface of said skirt portion at about a juncture with said top wall portion, adjacent to said gripping extension.

7. The dual opening dispensing closure in accordance with claim 1, wherein said hinge lines are parallel to one another.

8. A dual opening dispensing closure for use with an associated container comprising:

a closure cap having a circular top wall portion and a depending annular skirt portion depending from said top wall portion, said top wall portion defining first and second open dispensing regions therein, at least one of said dispensing openings defining a plurality of relatively small perforations;

a first cover portion for covering said first dispensing region, said first cover portion being connected to said top wall portion by a first hinge region; and a second cover portion for covering said second dispensing region, said second cover portion being connected to said top wall portion by a second hinge region, a separating portion extending between and separating said first and second dispensing regions, wherein said first and second hinge regions define respective first and second hinge lines perpendicular to said separating portion, each said hinge line intersecting said separating portion in spaced relation to one another.

* * * * *